US008770185B2

(12) United States Patent
Huang et al.

(10) Patent No.: US 8,770,185 B2
(45) Date of Patent: Jul. 8, 2014

(54) GAS FIREPLACE WITH GAS CONTROLLING DEVICE AND METHOD OF CONTROLLING GAS CONSUMPTION OF THE GAS FIREPLACE

(71) Applicant: Grand Mate Co., Ltd., Taichung (TW)

(72) Inventors: Chung-Chin Huang, Taichung (TW); Chin-Ying Huang, Taichung (TW); Hsin-Ming Huang, Taichung (TW); Hsing-Hsiung Huang, Taichung (TW); Kuan-Chou Lin, Taichung (TW); Yen-Jen Yeh, Yunlin County (TW)

(73) Assignee: Grand Mate Co., Ltd., Taichung (TW)

( * ) Notice: Subject to any disclaimer, the term of this patent is extended or adjusted under 35 U.S.C. 154(b) by 0 days.

(21) Appl. No.: 13/777,006

(22) Filed: Feb. 26, 2013

(65) Prior Publication Data

US 2014/0034041 A1 Feb. 6, 2014

(30) Foreign Application Priority Data

Aug. 3, 2012 (TW) ..... 101128064 A

(51) Int. Cl.
*F24B 1/187* (2006.01)

(52) U.S. Cl.
USPC ..... 126/502; 126/503; 126/116 A; 431/12

(58) Field of Classification Search
USPC ..... 126/502, 503, 116 A; 431/8, 12
See application file for complete search history.

(56) References Cited

U.S. PATENT DOCUMENTS 5,890,485 A * 4/1999 Shimek et al. ..... 126/512
2002/0086255 A1* 7/2002 Chen ..... 431/51

* cited by examiner

*Primary Examiner* — Alfred Basichas
(74) *Attorney, Agent, or Firm* — Ming Chow; Sinorica, LLC

(57) ABSTRACT

A gas fireplace includes a gas valve, a combustor, and a gas controlling device between the gas valve and the combustor. The gas controlling device has a body, a solenoid valve, and a main controller. The body has a first port, a second port, a first passage, and a second passage, wherein the first passage and the second passage respectively connect the first port to the second port. The solenoid valve is provided in the first passage to be controlled to open and close the first passage. The main controller alternately turns the solenoid valve on and off so as to repeatedly open and close the first passage. Therefore, the gas controlling device provides a variable gas flow to the combustor to reduce the total gas consumption and the user will not be aware of the change of the flames.

4 Claims, 4 Drawing Sheets

GAS FIREPLACE WITH GAS CONTROLLING DEVICE AND METHOD OF CONTROLLING GAS CONSUMPTION OF THE GAS FIREPLACE

The current application claims a foreign priority to the patent application of Taiwan No. 101128064 filed on Aug. 3, 2012.

BACKGROUND OF THE INVENTION

1. Field of the Invention

The present invention relates generally to a gas stove, and more particularly to a gas fireplace with a gas controlling device and a method of controlling a gas consumption of the gas fireplace.

2. Description of the Related Art

In early days, there was always a fireplace in the house for winter time. However, the air conditions have replaced the fireplace to warm the room, and the fireplace becomes a decoration in a modern house. FIG. 1 shows a conventional gas fireplace 100, a gas valve 10, a gas controller 12, and a combustor 14. The gas valve 10 is connected to a gas pipe 16 to turn the gas supply on or off. The gas valve 10 has a pilot assembly 10*a*, which has an outlet 10*b* beside the combustor 14 to burn gas of the combustor 14. The gas controller 12 is between the gas valve 10 and the combustor 14 to be operated to adjust the gas flow to the combustor 14. The combustor 14 burns the gas and generates flames.

As shown in FIG. 2, there is a constant gas flow in the gas pipe 16, so that the gas consumption is positive proportional to the time of burning gas while the flames are kept the same. However, the gas is more and more expensive which means that the cost of burning the fireplace is higher than ever.

SUMMARY OF THE INVENTION

The primary objective of the present invention is to provide a gas controlling device and a method of controlling a gas consumption of the gas fireplace, which may save the gas.

According to the objective of the present invention, the present invention provides a gas fireplace, including a gas valve, a combustor, and a gas controlling device. The gas valve is connected to a gas pipe. The gas controlling device has a body, a solenoid valve, and a main controller. The body has a first port, a second port, a first passage, and a second passage, wherein the first port is connected to the gas valve, the second port is connected to the combustor, and the first passage and the second passage respectively connect the first port to the second port. The solenoid valve is provided in the first passage to be controlled to open and close the first passage; and the main controller alternately turns the solenoid valve on and off so as to repeatedly open and close the first passage.

In an embodiment, the gas controlling device further having a gas controller between the second port of the body and the combustor, and the gas controller has a passage, and a diameter of the passage of the gas controller is greater than a diameter of the second passage of the body.

In an embodiment, the main controller has a signal generating unit to provide a high-level activating signal or a low-level activating signal to the solenoid valve, and the solenoid valve is a normally-open type solenoid valve whereby the solenoid valve is turned off while the signal generating unit provides the high-level activating signal, and the solenoid valve is turned on while the signal generating unit provides the low-level activating signal.

In an embodiment, the main controller has a signal generating unit to provide a high-level activating signal or a low-level activating signal to the solenoid valve, and the solenoid valve is a normally-close type solenoid valve whereby the solenoid valve is turned on while the signal generating unit provides the high-level activating signal, and the solenoid valve is turned off while the signal generating unit provides the low-level activating signal.

In an embodiment, a time of the solenoid valve being turned on plus a time of the solenoid valve being turned off is less than 0.2 seconds.

In an embodiment, the solenoid valve is mounted in the body.

In an embodiment, the gas valve has a pilot assembly, which has an outlet beside the combustor to burn gas of the combustor.

A method of controlling a gas combustor of the gas fireplace includes the following step:

A. providing a first gas flow to a combustor for a first time;

B. providing a second gas flow to the combustor for a second time; and

C. repeating the step A and the step B until the gas fireplace is turned off.

In an embodiment, the gas fireplace has a gas controlling device; the gas controlling device has a body and a solenoid valve; the body has a first port, a second port, a first passage and a second passage; the first passage and the second passage respectively connect the first port to the second port; gas enters the body via the first port and leaves the body via the second port; the solenoid valve is provided in the first passage to be controlled to open or close the first passage, whereby the gas controlling device provides the first gas flow while the solenoid valve opens the first passage, and the gas controlling device provides the second gas flow while the solenoid valve closes the first passage.

In an embodiment, the first gas flow is greater than the second gas flow.

In an embodiment, the second gas flow is greater than zero.

In an embodiment, the first time plus the second time is equal to or less than 0.2 seconds.

The present invention provides a variable gas flow to the combustor to reduce the total gas consumption and the user will not be aware of the change of the flames.

DETAILED DESCRIPTION OF THE INVENTION

The detailed description and technical contents of the present invention will be explained with reference to the accompanying drawings. However, the drawings are illustrative only but not used to limit the present invention.

Figure 1:
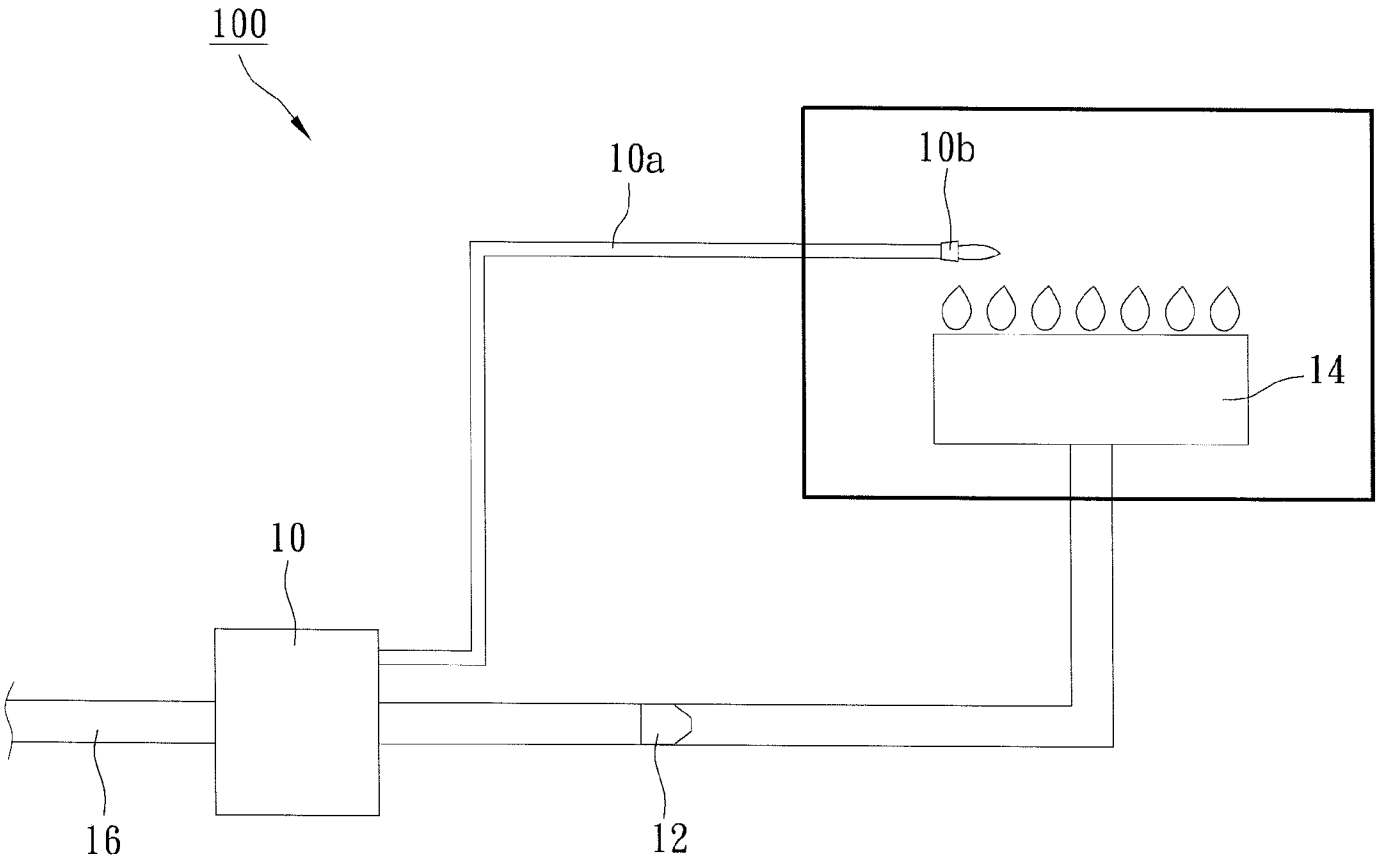
FIG. 1 (PRIOR ART)
FIG. 1 is a block diagram of the conventional gas fireplace.
Figure 2:
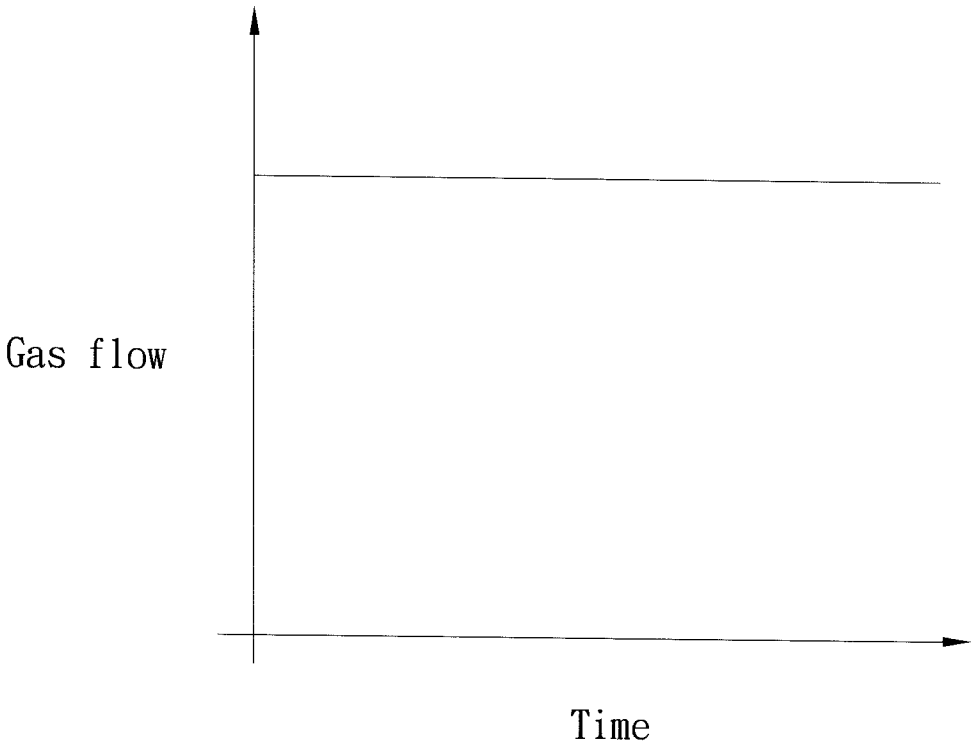
FIG. 2 (PRIOR ART)
FIG. 2 is a diagram, showing the relationship of the gas consumption and time of the gas fireplace.
Figure 3:
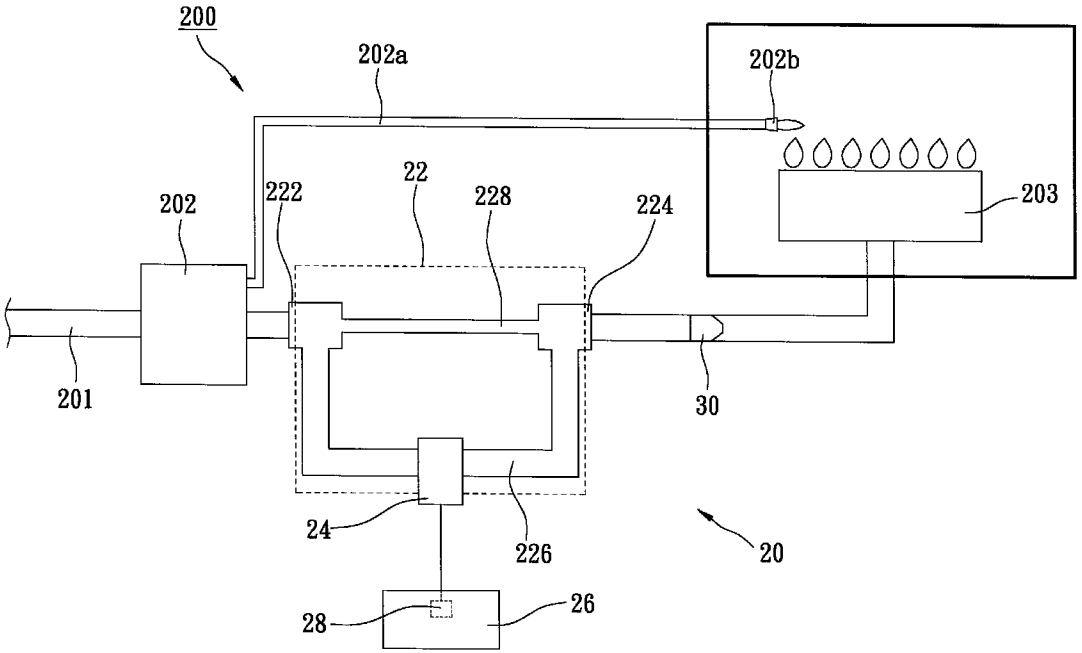
FIG. 3 is a block diagram of the gas fireplace of a preferred embodiment of the present invention.

As shown in FIG. 3, a gas fireplace 200 of the preferred embodiment of the present invention, which is connected to a gas pipe 201, includes a gas valve 202, a combustor 203, and a gas controlling device 20.

The gas valve 202 is connected to the gas pipe 201 to turn gas supply on or off. The gas valve 216 has a pilot assembly 202*a*, which has an outlet 202*b* beside the combustor 203 to burn the gas of the combustor 203.

The gas controlling device 20 has a body 22 and a solenoid valve 24, a main controller 26, and a gas controller 30.

The body 22 has a first port 222, a second port 224, a first passage 226 and a second passage 228. The gas valve 202 is connected to the first port 222 through a hose so that the gas enters the body 22 via the first port 222 and leaves the body 22 via the second port 224. The second port 224 is connected to the combustor 203. The first passage 226 and the second passage 228 respectively connect the first port 222 to the second port 224.

The solenoid valve 24 is mounted in the first passage 226 to open or close the first passage 226. Therefore, the gas flow out of the second port 224 is controllable by switching the solenoid valve 24. The solenoid valve 24 is a normally-open solenoid valve and is built in the body 22 in the present embodiment.

The main controller 26 is electrically connected to the solenoid valve 24 and has a signal generating unit 28. The signal generating unit 28 periodically generates an activating signal and sends it to the solenoid valve 24 to open or close the first passage 366. In an embodiment, when the signal generating unit 28 generates a high-level activating signal and sends it to the solenoid valve 24, the solenoid valve 24 is turned on so as to open the first passage 226. At this time, the second port 224 provides a first gas flow which is a sum of gas flows both in the first passage 226 and in the second passage 228. When the signal generating unit 28 generates a low-level activating signal and sends it to the solenoid valve 24, the solenoid valve 24 is turned off so as to close the first passage 226. At this time, the second port 224 provides a second gas flow which is identical to a gas flow in the second passage 228 only.

The gas controller 30 is between the combustor 203 and the second port 224 of the main controller 26. The gas controller 30 is a tubular member and has a passage. A diameter of the passage of the gas controller 30 is greater than a diameter of the second passage 228 of the main controller 22. Therefore, when the signal generating unit 28 provides a low-level activating signal, which means that the first passage 226 is closed, a gas flow out of the gas controller 30 is identical to the second gas flow. It is obviously that the first gas flow is greater than the second gas flow.

Figure 5:
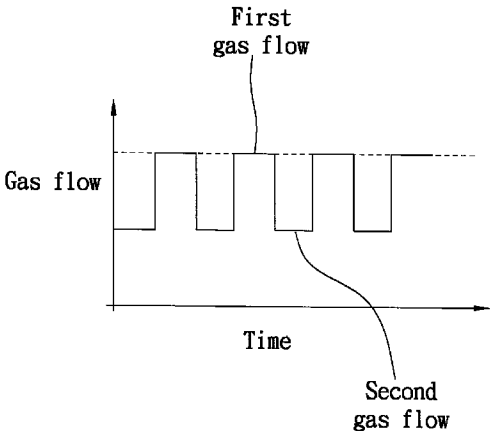
FIG. 5 is a diagram, showing the relationship of the gas consumption and time of the gas fireplace of the preferred embodiment of the present invention.
Figure 4:
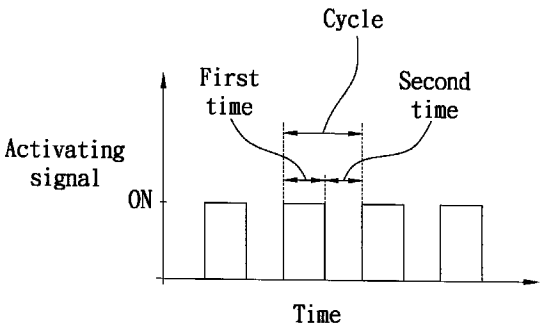
FIG. 4 is a wave diagram of the activating signals.

As shown in FIG. 4, the signal generating unit 28 alternately provides the high-level and the low-level activating signals with a specific frequency to alternately turn the solenoid valve 24 on and off, therefore the first passage 226 is opened and closed accordingly. Precisely, the signal generating unit 28 provides the high-level activating signal for a first time, and then provides the low-level activating signal for a second time. It will repeatedly open the second passage 228 for the first time and close the second passage 228 for the second time. As shown in FIG. 5, as a result, the gas controlling device 20 will alternately provides the first gas flow and the second gas flow to the combustor 203.

In comparison with the conventional gas fireplace, the gas fireplace 200 of the present invention alternately provides the first gas flow (high gas flow) and the second gas flow (low gas flow), so that the total gas consumption will be less than the conventional gas fireplace, which provides the high gas flow all the time. If the second time is longer in a cycle, which means that the first time will be shorter, the totally gas consumption will be reduced again.

It is easy to understand that the flames will be repeatedly large and small because of the change of the gas flow. In order to reduce the effect of the change of the flames, the preferable frequency of change of the gas flow is greater than 5,which means that the first passage 226 is closed and opened within 0.2 seconds. With such frequency, people will not aware of the change of the flames.

A method of performing the saving gas consumption of the fireplace 200 as described above includes the following steps:

A. Provide the first gas flow to the combustor 203 for the first time.

In this step, the signal generating unit 28 of the main controller 26 provides the high-level activating signal for the first time to turn the solenoid valve 24 on, so as to open the first passage 226. Therefore, the first gas flow is supplied to the combustor 203 to have large flames.

B. Provide the second gas flow to the combustor 203 for the first time.

While the first time is up, the signal generating unit 28 immediately stops the high-level activating signal and provides the low-level activating signal for the second time. At this time, the solenoid valve 24 is turned off so as to close the first passage 226. Therefore, the second gas flow is supplied to the combustor 203 to have small flames.

C. Repeat the step A and the step B until the gas fireplace 200 is turned off.

In this step, the signal generating unit 28 repeatedly provides the high-level activating signal for the first time and the low-level activating signal for the second time. It is preferable that the first time plus the second time is shorter than 0.2 seconds.

The present invention provides a variable gas flow to the combustor 203 to reduce the total gas consumption and the user will not be aware of the change of the flames.

In practice, the main controller 24 may work alone without the gas controller 30. The solenoid valve may be normally-open type or normally-close type. When use the normally-close type solenoid valve, the first passage 226 is closed when the signal generating unit 28 provides the low-level activating signal, and the first passage 226 is opened when the signal generating unit 28 provides the high-level activating signal.

The description above is a few preferred embodiments of the present invention, and the equivalence of the present invention is still in the scope of claim construction of the present invention.

What is claimed is:

1. A method of controlling a gas consumption of a gas fireplace which has a gas controlling device having a body and a solenoid valve, wherein the body has a first port through which gas enters the body, a second port through which gas leaves the body, a first passage connecting the first port and the second port with the solenoid valve provided within to be opened or closed, and a second passage also connecting the first port and the second port, comprising the steps of:

A. providing a first gas flow to a combustor for a first time while the solenoid valve opens the first passage;

B. providing a second gas flow to the combustor for a second time while the solenoid valve closes the first passage; and C. repeating the step A and the step B until the gas fireplace is turned off.

2. The method as defined in claim 1, wherein the first gas flow is greater than the second gas flow.

3. The method as defined in claim 2, wherein the second gas flow is greater than zero.

4. The method as defined in claim 1, wherein the first time plus the second time is equal to or less than 0.2 seconds.

* * * * *